US010102833B1

(12) United States Patent
May

(10) Patent No.: US 10,102,833 B1
(45) Date of Patent: Oct. 16, 2018

(54) MUSICAL DRUMHEAD

(71) Applicant: REMO, INC., Valencia, CA (US)

(72) Inventor: James H. May, Valencia, CA (US)

(73) Assignee: REMO, INC. A California Corporation, Valencia, CA (US)

( * ) Notice: Subject to any disclaimer, the term of this patent is extended or adjusted under 35 U.S.C. 154(b) by 0 days.

(21) Appl. No.: 15/680,162

(22) Filed: Aug. 17, 2017

(51) Int. Cl.
*G10D 13/02* (2006.01)

(52) U.S. Cl.
CPC ..... *G10D 13/027* (2013.01)

(58) Field of Classification Search
CPC ..... G10D 13/027
See application file for complete search history.

(56) References Cited

U.S. PATENT DOCUMENTS 729,936 A * 6/1903 Heybeck ..... G10D 13/027 84/414
4,282,011 A * 8/1981 Terpay ..... B24D 11/02 139/420 C
4,770,918 A * 9/1988 Hayashi ..... B32B 5/12 428/113
4,828,907 A * 5/1989 Hayashi ..... B32B 5/12 442/217
5,920,026 A * 7/1999 Yoshino ..... G10D 13/024 84/414
6,921,857 B2 * 7/2005 Yoshino ..... G10D 13/024 84/414
7,795,519 B2 * 9/2010 Hsien ..... G10D 13/027 84/414
8,933,310 B2 * 1/2015 Rogers ..... G10D 13/02 84/104
2013/0312585 A1 * 11/2013 Yunbin ..... G10D 13/027 84/414

* cited by examiner

*Primary Examiner* — Robert W Horn
(74) *Attorney, Agent, or Firm* — Larry F. Gitlin

(57) ABSTRACT

A musical drumhead having a plurality of multifilament yarns joined to form an open weave mesh fabric wherein the surface of the multifilament yarns is uneven or undulating for enabling a strong bond with an applied coating, which, in turn, is provided to encapsulate the individual multifilament yarns. When struck by a hard object, the open weave mesh fabric absorbs vibrations resulting in a sound that simulates the sound properties of a modern day synthetic drumhead at substantially reduced sound levels. Integrating a plurality of soft fiber tufts into the surface (top and bottom) of the mesh fabric reduces the sound levels produced by the drumhead of the present invention even further.

24 Claims, 9 Drawing Sheets

MUSICAL DRUMHEAD

DESCRIPTION OF THE PRIOR ART

1. Field of the Invention

The present invention relates generally to field of improved musical drumheads and more particularly to a drumhead that is produced from a composite open mesh fabric to enable the simulation of the playing, tuning, and single- and double-headed sound properties of a modern synthetic drumhead, including, for example, Mylar® (polyester), at substantially reduced volume levels.

2. Background of the Invention

Woven drumheads commercially available in the prior art include the single-ply Duraline™ head made from woven Kevlar® material, the Compo™ head, which was made from a woven impregnated cloth, and the Cana-Sonic™ head, also made from a plain woven synthetic material. In 1982, applicant was granted a patent for its FaLam® drumhead (U.S. Pat. No. 4,356,756), which was made from woven Kevlar® fabric. But, unlike Duraline™, the FaLam® drumhead incorporated a polyester sandwiched construction, which protected the woven fibers from separating and making the head airtight to the drum. The Duraline™ head allowed a large volume of air to pass through the membrane causing it to have a different sound than that of the preferred sound of the Mylar® head, which the improved drumhead of the present invention simulates in terms of its playing, tuning, and single- and double-headed sound properties, and which also precluded the passage of air given that its composition was that of a single piece of solid polyester. The Duraline™ head was used extensively on a single-headed electronic drum called Syndrum™. With Syndrum™, the main objective was to have a durable yet quiet drum surface where the vibration was detected and then translated to a sound module for amplification. Ultimately, the Duraline™ head was not very successful as the outer periphery weave separated. Comp™ and Cana-Sonic™ drumheads did not have a full range of sound compared to that of Mylar®. Thus, for these and other reasons, all three of these woven drumheads ceased production by the early 1980's.

Electronic drums of the mid-1970s and early 1980s included hard playing surfaces, which produced loud contact noises when struck with a drumstick and often caused discomfort to the drummer's hands because the surface had no rebound or shock absorption capability. Midi drum triggers became popular in the late 1980's as the drummer could play on a regular drumhead and then "trigger" electronic sounds using various piezo sensors attached to the drumhead. The drumhead feel was relatively unchanged, although the triggers were not very accurate in translating fast musical passages and dynamics. Unfortunately, this type of electronic drumset, as a total package, was not available. The drums, triggers, midi unit, and the sound module all had to be purchased separately from different sources and then synchronized.

In the mid-90s, the Roland Corporation introduced an all-encompassing electronic drumset. To reduce the contact noise of typical plastic or rubber pads, the drumset was fitted with monofilament mesh drumheads comprised of two separate layers of material, as disclosed in U.S. Pat. No. 5,920,026. The objective of the two-ply Roland® mesh drumhead was to deliver sufficient vibration to trigger a sound module, with minimal sound coming from the drumhead itself.

However, the Roland® two-ply drumhead produced a rattling sound and had greater deflection causing it to become too bouncy or springy. Thus, the feel produced by the two-ply Roland® head was significantly inferior to that of a modern day drumhead made, for example, from a solid sheet of Mylar®.

In addition to the rattling noise and exaggerated bounce of the Roland® two-ply monofilament mesh head, a certain unwelcome noise was produced when a drumstick or any other similarly hard object struck the mesh, as both the stick and the monofilament strands have very hard surfaces that severely resonated when making contact.

A monofilament polyester mesh incorporates monofilament wires that consist of only one type of fiber, a single strand of continuous filament, which is a circular shaped wire with a smooth surface and a high degree of tenacity. These monofilament strands can be used to create a variety of weaves, including, for example, plain, twill, Dutch, and five-heddle weaves. The crossing points of these monofilament mesh fibers are typically melted together to secure the selected weave in place to prevent the strands from shifting. This consistently even and unwavering mesh structure is then able to regulate the amount of air that passes through it, which ultimately determines resonance and sound levels.

The tensioning of the monofilament woven polyester drumhead varies dramatically depending on the instrument. For example, a typical drumset has a snare drum, a bass drum, and assorted sizes of tom-toms, which, because of their sizes, are tensioned differently and, thus, differ in the degree of bounce produced when struck by a drumstick. However, because of the nature of the material, monofilament woven polyester drumheads are equally bouncy on small drums as they are on large drums. The result is an inauthentic synthetic drumhead experience for the drummer.

Most, if not all, mesh drumheads currently being manufactured are made from monofilament plain woven polyester, as previously described. These solid woven strands do not provide an authentic playing surface as they are extremely bouncy or springy in their composition. The monofilament fabric also has greater memory and is more stiff, the combination of which causes it to have that undesirable tennis racquet sound when under tension. This is extremely damaging to the integrity of an acoustical drum in which the tone of the drum is produced primarily by the bottom head of a double-headed drum. If the noise from the top head creates unwanted tone or noise of any kind, it will predominate even to the point of obscuring the tone of the bottom drumhead, thus making it impossible to record as a live instrument. This undesirable noise or tone also affects fellow ensemble players of, for example, electronic drums situated close by. If other acoustic instruments are being recorded next to or nearby electronic drums, the monofilament woven mesh drumhead noise will interfere with the recording of those instruments, as well.

Applicant was the first to introduce a single-ply monofilament mesh drumhead for semi-quiet practice on acoustic drums, which allowed for a sufficient amount of air to pass through the fabric to cause the bottom resonant head to vibrate and produce a tone with melodic patterns. Because of the single-ply head, no rattling noises were produced unlike, for example, the Roland® two-ply mesh head. However, the single-ply head continued to have an exaggerated springy and unnatural feel when played. Among other negatives, this caused some degree of shock to the drummer's foot, as the now weighted beater attempted to prevent the vibrations of a material that had considerably more deflection than that of a drumhead made from a solid sheet of Mylar™.

Thus, in contrast to the drawbacks associated with prior art mesh heads experienced specifically by single- and double-ply monofilament mesh drumheads, as described heretofore, multifilament yarns utilized with the improved drumhead of the present invention typically yield less stretch while having greater tensile strength, pliability, and flexibility, which results in a durable drumhead that feels and torques similarly to that of a solid polyester sheet, such as Mylar®. Since the individual strands are not bonded, but rather twisted or braided, or combined in some other suitable fashion, they tend to have a more uneven or undulating surface compared to the typical smooth consistent surface of monofilament strands. The uneven or undulating surface acts to enhance the adhesion potential of vinyl and other coatings, and also inhibits vibration. This coating bonds the vinyl to the uneven or undulating surface of the individual yarns much more effectively than the lamination process can achieve, thus creating a superior bond and a one-piece composite. It also eliminates the off-bias stretch tendency normally associated with an unlaminated plain woven material.

Vinyl coatings also provide additional tensile and tear strength, reduction in elongation, and overall dimensional stability, and add dampening capability to the already reduced vibrations of the multifilament yarns. Vinyl coatings absorb vibrations and add a soft exterior to whichever substrate they adhere to. Thus, when a vinyl coated open mesh fabric drumhead is struck with a wood drumstick, the contact noise is significantly reduced. The player also experiences a softer playing "feel" and less bounce.

Vinyl coatings further provide the means for enabling open mesh fabric to remain stable, thus precluding a shift in any direction (i.e., the off-bias effect). Encapsulation specifically inhibits, if not totally precludes, the stretching of the fabric material (drumhead) in any direction, thus ensuring that equal and reliable tensioning throughout is maintained.

Dampening the actual noise produced by a drumstick striking a vinyl-coated open mesh fabric drumhead is enhanced further by integrating soft "fuzzy" olefin or other types of synthetic fiber tufts into both sides of the mesh fabric. Aside from providing a soft landing or contact surface for the drumstick, these tufts also absorb vibrations and virtually eliminate the undesirable tennis racket sound normally associated with certain drumheads in the prior art, as described. This combination of the elements described heretofore creates a unique low volume drumhead for both acoustic and electronic instruments with realistic bounce and torque characteristics almost identical to that of a preferred modern day synthetic drumhead.

Thus, the improved drumhead of the present invention comprises an open mesh fabric material produced from encapsulated-coated multifilament yarns, and, in an alternative embodiment, integrated fiber tufts used in combination to substantially reduce the sound levels and provide a similar playing "feel" to that of a modern day synthetic drumhead. When used as the batter head of a double-headed drum, the bottom resonant head, typically a solid sheet of polyester, for example, Mylar®, becomes the sympathetic vibratory membrane, which produces a low volume non-contact sound or tone for quiet practice or for recording with other soft acoustic instruments. When used on a single- or double-headed drum in an electronic application there is no rattling sound, which is normally associated with a monofilament two- or more-ply mesh drumhead, nor is there the high bounce characteristic of a single- or multi-ply monofilament drumhead. Little or no tone can be heard when the open mesh fabric drumhead of the present invention is used as a single-headed drum, with no resonant drumhead, and even more so when combined with the integrated soft fiber tufts, which substantially aid in dampening any stick contact noise and resulting reverberation.

Accordingly, the improvement of the present invention resolves the problems described above and associated with the prior art drumheads by providing a multifilament open mesh fabric for producing a drumhead which accurately simulates the sound properties of a modern day synthetic drumhead at substantially reduced volume levels.

SUMMARY OF THE INVENTION

In its preferred embodiment, the present invention constitutes an improved musical drumhead having a plurality of multifilament yarns joined to form an open mesh fabric. The multifilament yarns, which may be twisted, braided, or joined in any other suitable manner, have uneven or undulating surfaces for enabling a strong bond with an applied coating, which encapsulates the mesh fabric and then hardens. When struck by a hard object, the open mesh fabric, particularly when used in combination with a resonant head in a double-headed drum, absorbs vibrations resulting in a sound that simulates the sound properties of a modern day synthetic drumhead at substantially reduced sound levels. Integrating a plurality of soft fiber tufts into the surface (top and bottom) of the mesh fabric reduces the sound levels produced by the drumhead of the present invention even further.

Accordingly, it is an object of the present invention to provide a musical drumhead comprised of twisted or braided multifilament yarns to form a woven, knitted or knotted open mesh fabric, which, when struck by a hard object like a drumstick, absorbs vibrations and simulates the sound properties of modern day synthetic drums at substantially reduced sound levels.

Another object of the present invention is to provide a musical drumhead wherein the multifilament yarns join to form an open mesh fabric and are individually coated with a coating material that forms a strong bond with the fabric to prevent movement of the yarns in any direction when the fabric is tensioned or struck by a hard object.

Another object of the present invention is to provide a musical drumhead wherein the multifilament yarns of the open mesh fabric are individually coated by a molten polyvinyl chloride material and then allowed to cure to ensure the strong bond.

Still another object of the present invention is to provide a musical drumhead wherein the multifilament yarns form a woven mesh fabric with a weave pattern that enables the intersecting individual multifilament yarns to define adjacent openings of various sizes to allow the passage of air to flow to the resonant head and the resonant head to vibrate.

Still another object of the present invention is to provide a musical drumhead produced from an open mesh fabric made from multifilament polyester yarns.

Yet another object of the present invention is to provide a musical drumhead produced from an open mesh fabric made from multifilament nylon yarns.

Still another object of the present invention is to provide a musical drumhead produced from an open mesh fabric, which is then combined with tufted soft fibers to reduce the initial contact noise and the accompanying drumhead reverberations otherwise produced when the drumstick strikes the head.

Yet another object of the present invention is to provide a musical drumhead, which integrates multifilament yarns joined to form an open mesh fabric and a plurality of fiber tufts which, when struck by a hard object, like a drumstick, will better absorb vibrations to result in a sound that both simulates the sound properties of a modern day synthetic drumhead and substantially reduces sound levels.

Still another object of the present invention is to provide a musical drumhead integral to an electric percussion instrumental system.

Still another object of the present invention is to provide a musical drumhead integral to an acoustic percussion instrument.

Yet another object of the present invention is to provide a musical drumhead comprising two or more layers of open mesh fabric.

Still another object of the present invention is to provide a musical drumhead wherein one layer of an open mesh fabric is placed in an off-biased orientation relative to one or more other layers of an open mesh fabric.

Other objects and advantages of the present invention in all of its embodiments will become apparent in the following specifications when considered in light of the attached drawings wherein the preferred and alternative embodiments of the present invention are further illustrated.

DETAILED DESCRIPTION OF THE PREFERRED EMBODIMENT

Figure 1:
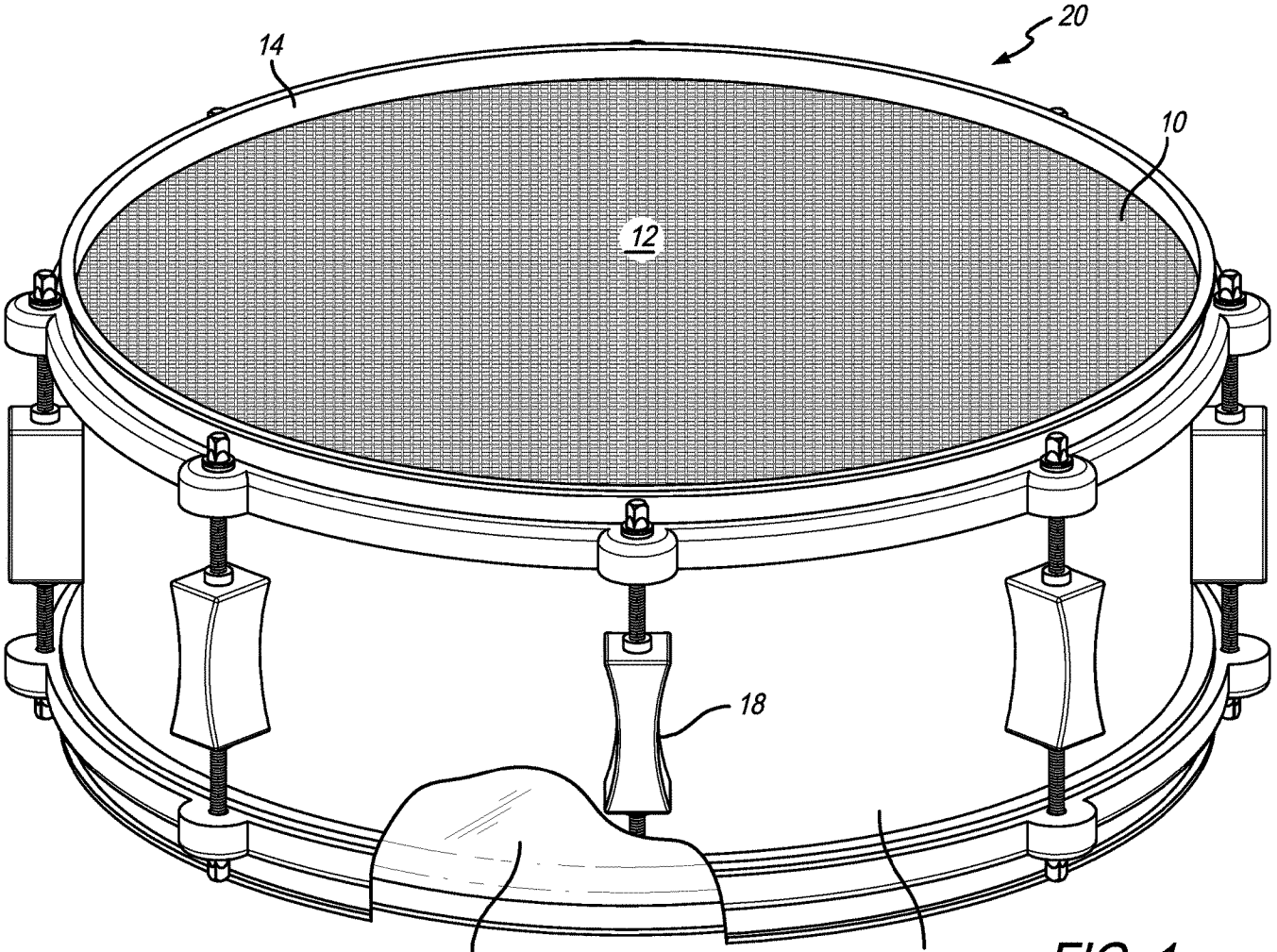
FIG. 1 is a perspective view of a drumhead in accordance with the present invention shown with a double-headed drum, including a resonant head, and comprised of vinyl-coated multifilament twisted yarns combined with a conventional drumshell and tensioning hardware.
Figure 1A:
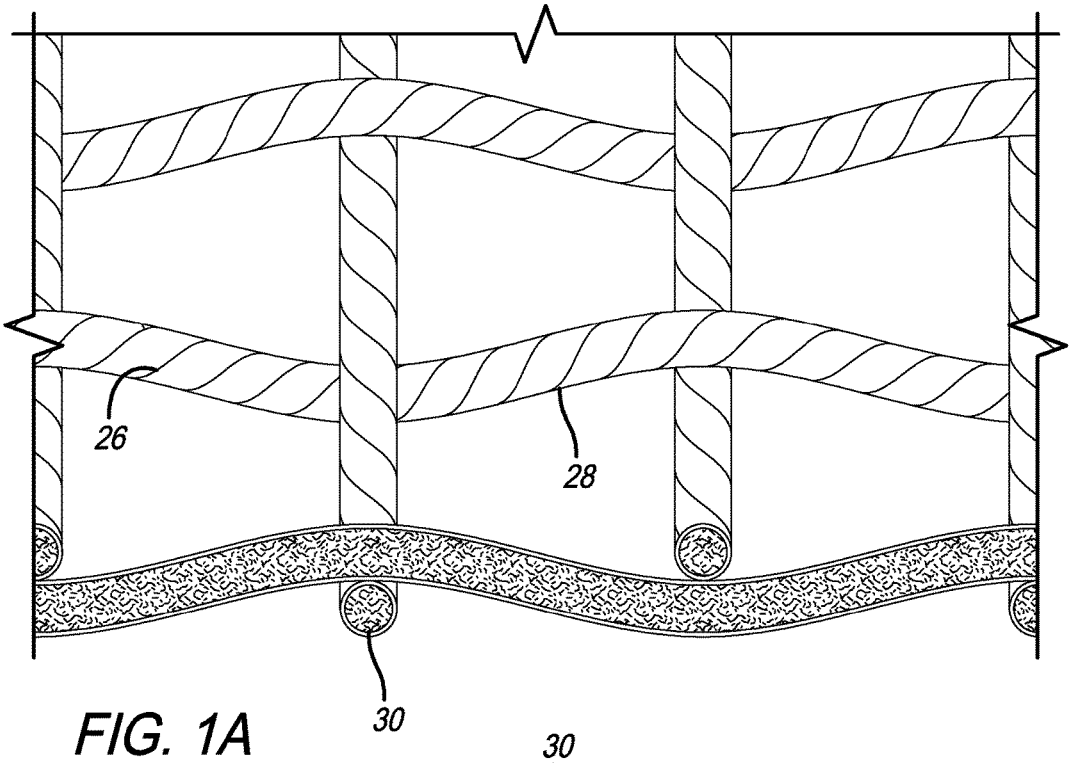
FIG. 1A is a perspective view of an enlarged section of the open mesh fabric shown in FIG. 1 detailing a group of twisted multifilament yarns used to create a weave.
Figure 1B:
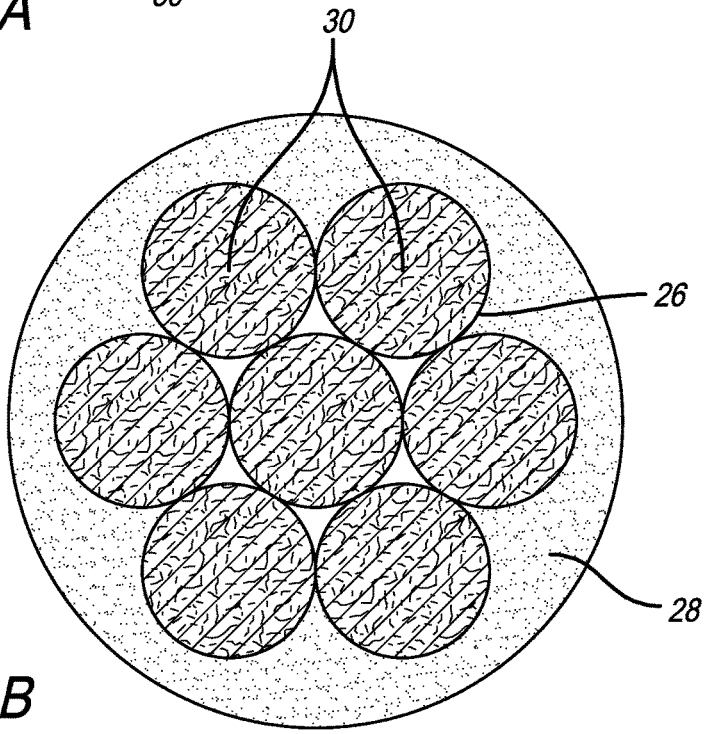
FIG. 1B is a cross-section of a coated single strand of twisted multifilament yarns of the type used to make the open weave mesh fabric shown in FIG. 1 and FIG. 1A.
Figure 2:
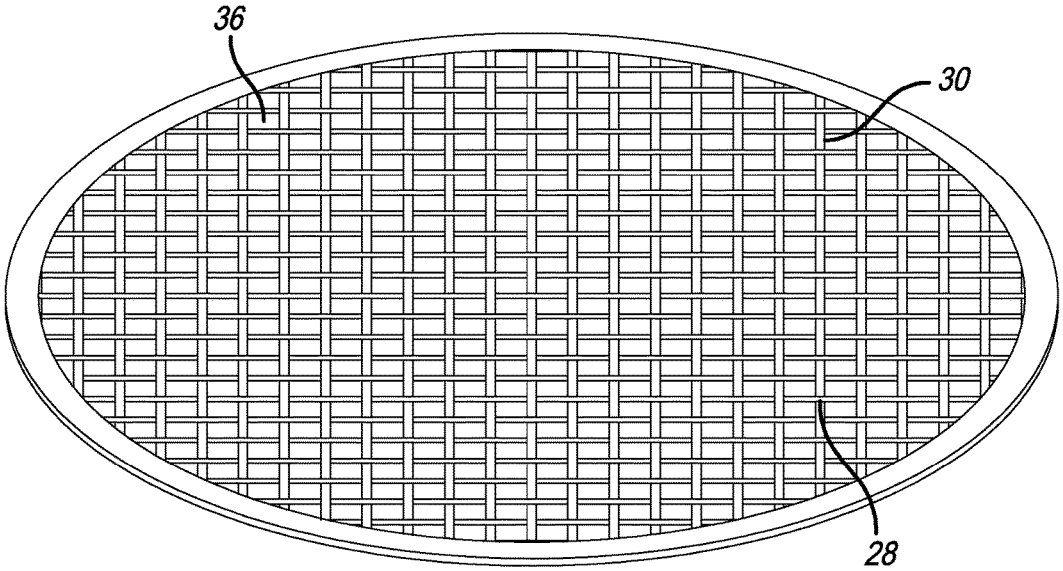
FIG. 2 is a perspective view of an alternative embodiment of a drumhead in accordance with the present invention shown comprised of vinyl-coated multifilament yarns.
Figure 3:
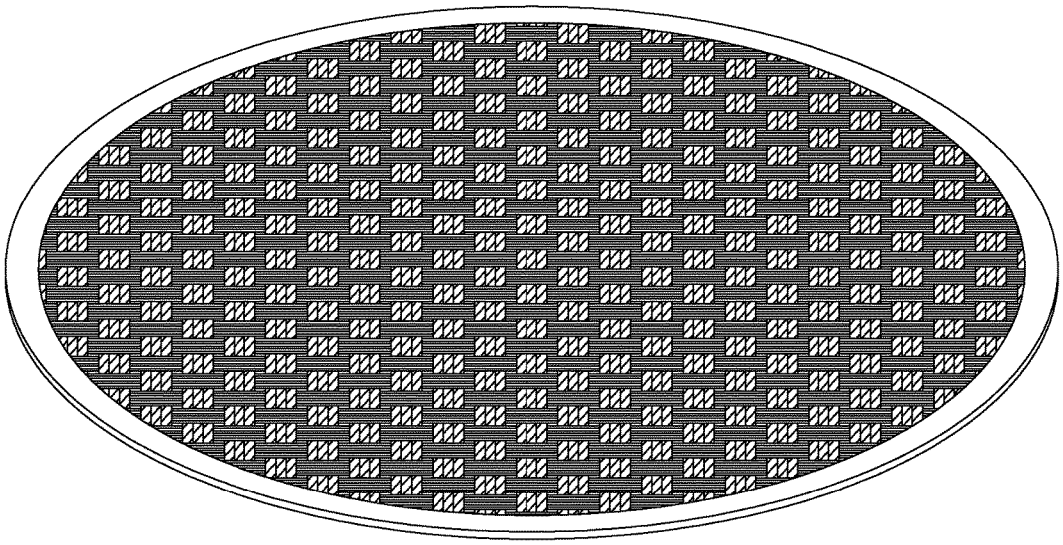
FIG. 3 is a perspective view of an alternative embodiment of a drumhead in accordance with the present invention shown comprised of vinyl-coated multifilament twisted yarns.

The present invention, which will be described in more detail with reference to the preferred embodiment in FIG. 1, provides a composite open weave mesh fabric material 10 for fashioning drumhead 12 attached to counterhoop 14 which, in turn, is brought together with drum shell 16 to construct either a double-headed drum 20 having a bottom resonant head 22, or a single-headed drum 24. Conventional tensioning hardware 18 is employed to ensure drumhead 12 is properly tensioned. Multifilament yarns 30, whether twisted or braided, or in whatever manner the yarn is otherwise joined, typically has an uneven or undulating surface 26, which enables a strong bond with applied coating 28. Applied coating 28, in turn, encapsulates individual multifilament yarns 30, which aids in absorbing vibrations when drumhead 12 is struck by a hard object such as, for example, drumstick 32. This results in achieving the sound properties of a modern day synthetic drumhead at substantially reduced sound levels.

Figure 6:
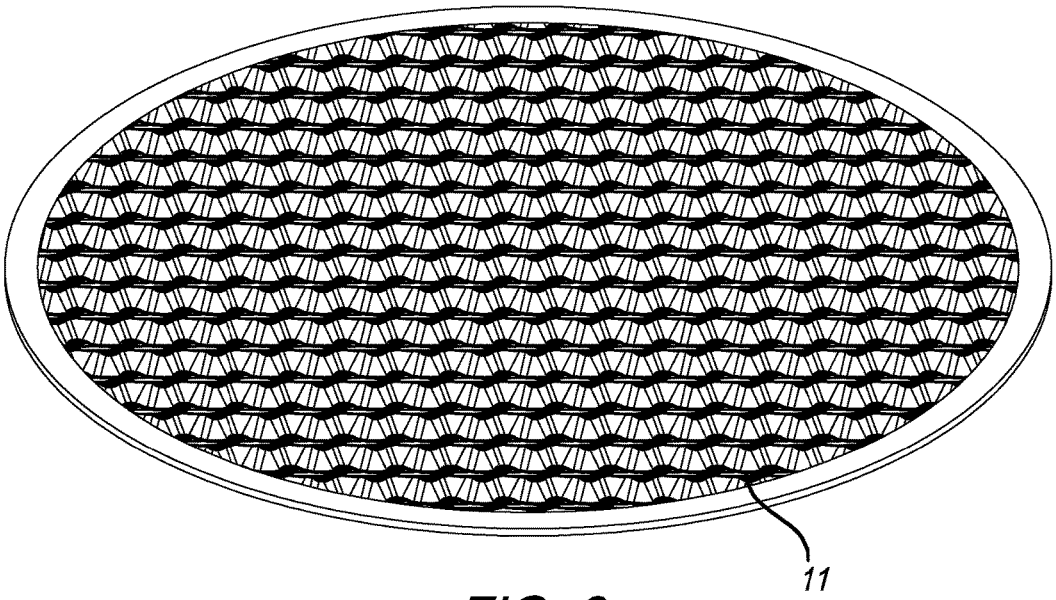
FIG. 6 is a perspective view of a drumhead in accordance with the present invention shown comprised of a knitted mesh material.
Figure 7:
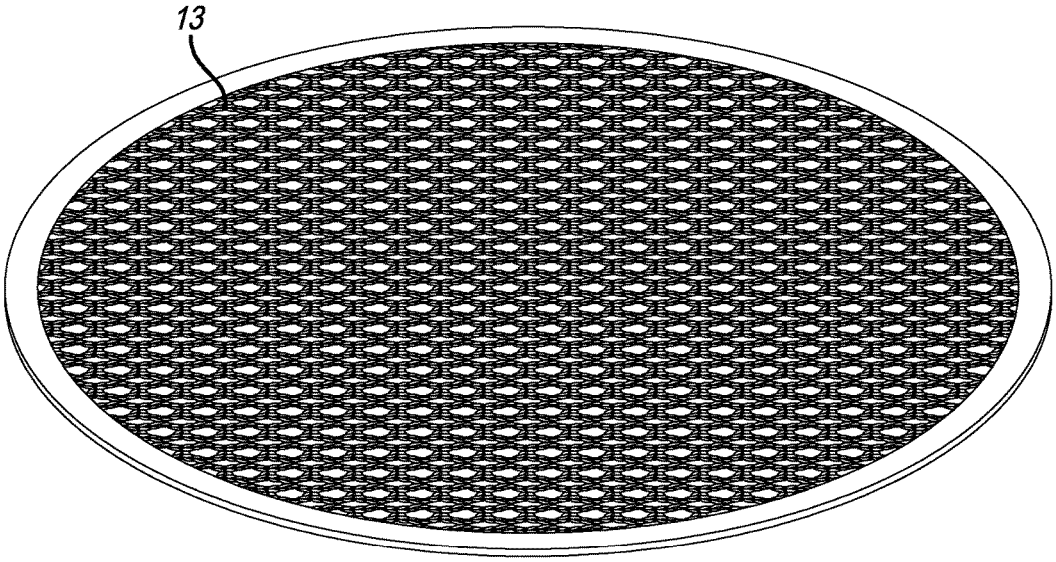
FIG. 7 is a perspective view of an alternative embodiment of a drumhead in accordance with the present invention shown comprised of a variant of a knitted weave mesh material.

Multifilament yarns 30 utilized to produce open weave mesh fabric material 10 of the present invention may be twisted (FIGS. 1,1A,1B,2,3), or braided (not shown), or joined in any other suitable manner. These yarns may be comprised of material, including, for example, polyester, nylon, among other synthetic or natural materials that may also be suitable for the intended purpose. Drumhead 12 may also be comprised of knitted mesh fabric 11 and 13 (FIGS. 6,7) or knotted mesh fabric (not shown) using a plurality of twisted or braided multifilament yarns 30 or any other suitable means for joining yarn material into an open mesh fabric to achieve the invention's objectives. The means to coat or encapsulate multifilament yarns 30 of the present invention may comprise cured molten polyvinyl chloride, polyvinylidene fluoride and high density polyethylene, or any other synthetic material suitable for this purpose.

Cured polyvinylchloride, as with any other suitable synthetic cured molten material, acts to ensure that the weave pattern of the open weave mesh fabric material 10, knitted mesh fabric material 11 and 13, and knotted mesh fabric material (not shown) remains secured in place to prevent any off-bias pull or stretching of the material upon the tensioning of drumhead 12 in any direction of a polar array (FIGS. 9,10) or when drumhead 12 is struck by a hard object.

Any of the weave, knitted or knotted patterns utilized, no matter the composition of the multifilament yarns used to produce them, comprise a series of connecting and intersecting individual multifilament yarns 30, which join to define adjacent various sized openings 36 to produce an open mesh pattern sufficient to enable the passage of air upon the striking of drumhead 12. The size of openings 36 determines the amount of air that passes through resonant head 22 below, for example, and thus, the amount of resonance, the tone and the sound levels produced by the struck drumhead 12.

Figure 4:
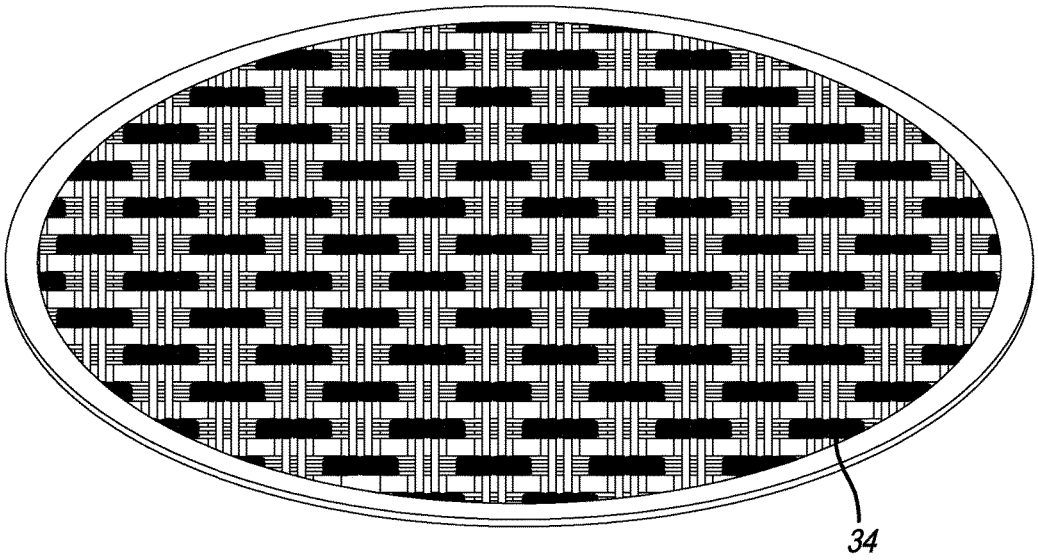
FIG. 4 is a perspective view of a drumhead in accordance with the present invention shown comprised of vinyl-coated multifilament yarns integrated with soft tufts of fiber.
Figure 5:
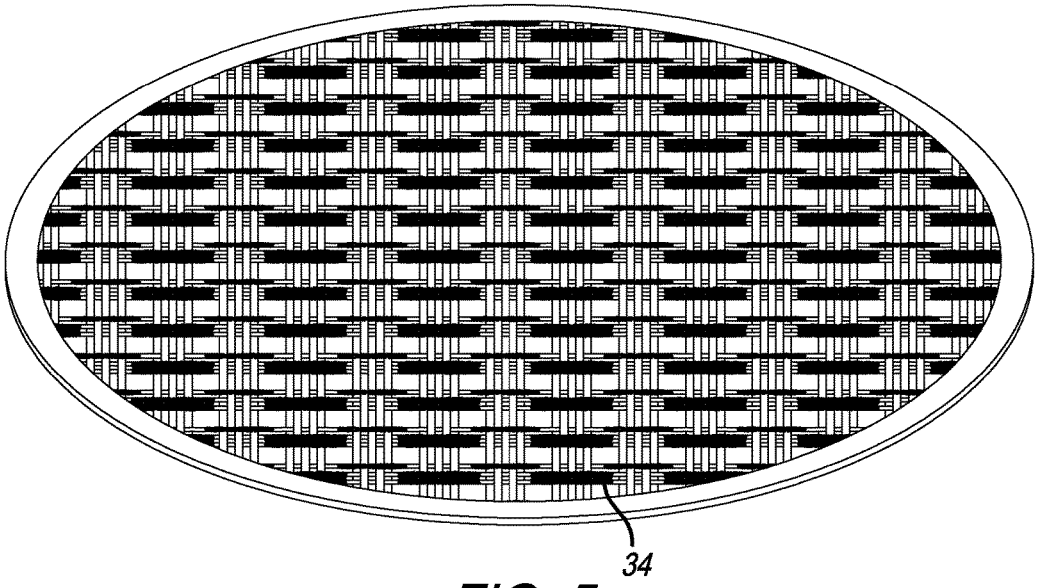
FIG. 5 is a perspective view of a drumhead in accordance with the present invention shown comprised of vinyl-coated multifilament yarns integrated with soft tufts of fiber in a different arrangement.

An alternative embodiment of the drumhead in accordance with the present invention comprises open weave mesh fabric material 10 produced from vinyl coated multifilament yarns integrated with a plurality of individual soft tufts of fiber material 34, such as olefin, as shown in varied arrangements in FIGS. 4,5. Olefins are synthetic fibers made from polyolefin, such as polypropylene or polyethylene. Soft fiber tufts 34 are provided as an integral component of open weave mesh fabric material 10 to reduce the initial contact noise and any accompanying drumhead reverberations. Tufts 34 also enhance the reduction of sound levels produced when drumhead 12 is struck by a hard object, such as drumstick 32 or any comparably hard object, for example, a drum mallet (not shown), utilized to produce the desired drum sounds.

Figures 8, 8A:
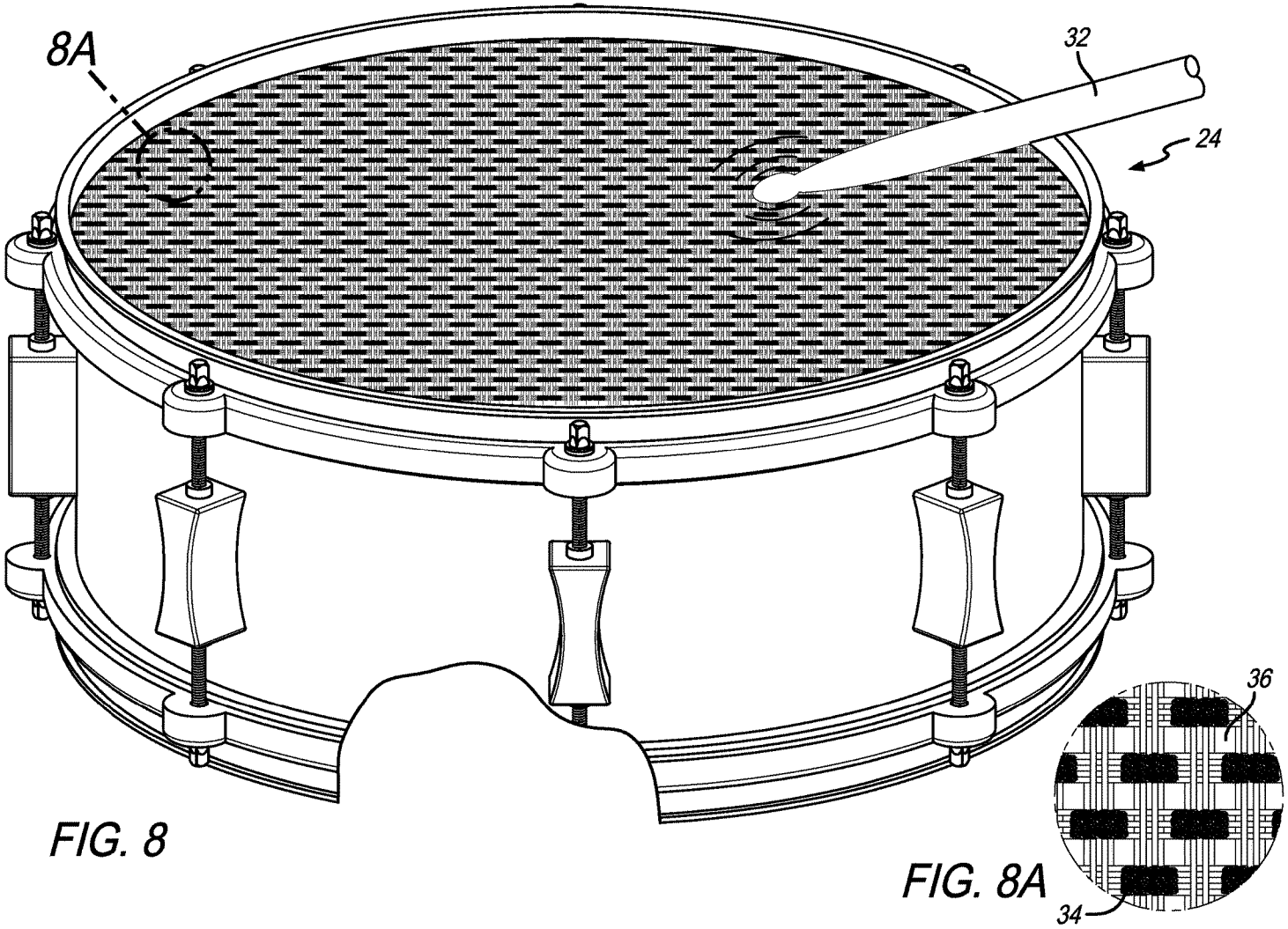
FIG. 8 is a perspective view of a single-headed musical drum in accordance with the present invention comprised of an open weave mesh material and shown with the head being percussed by a drumstick.
FIG. 8A is an enlarged section of the open weave mesh material shown in FIG. 8.

Drumhead 12 in accordance with the present invention may be utilized as an integral component of an acoustic percussion instrument, such as double-headed drum 20 and single-headed drum 24 shown in FIGS. 1,8, respectively, or an electronic percussion system (not shown).

Figure 9:
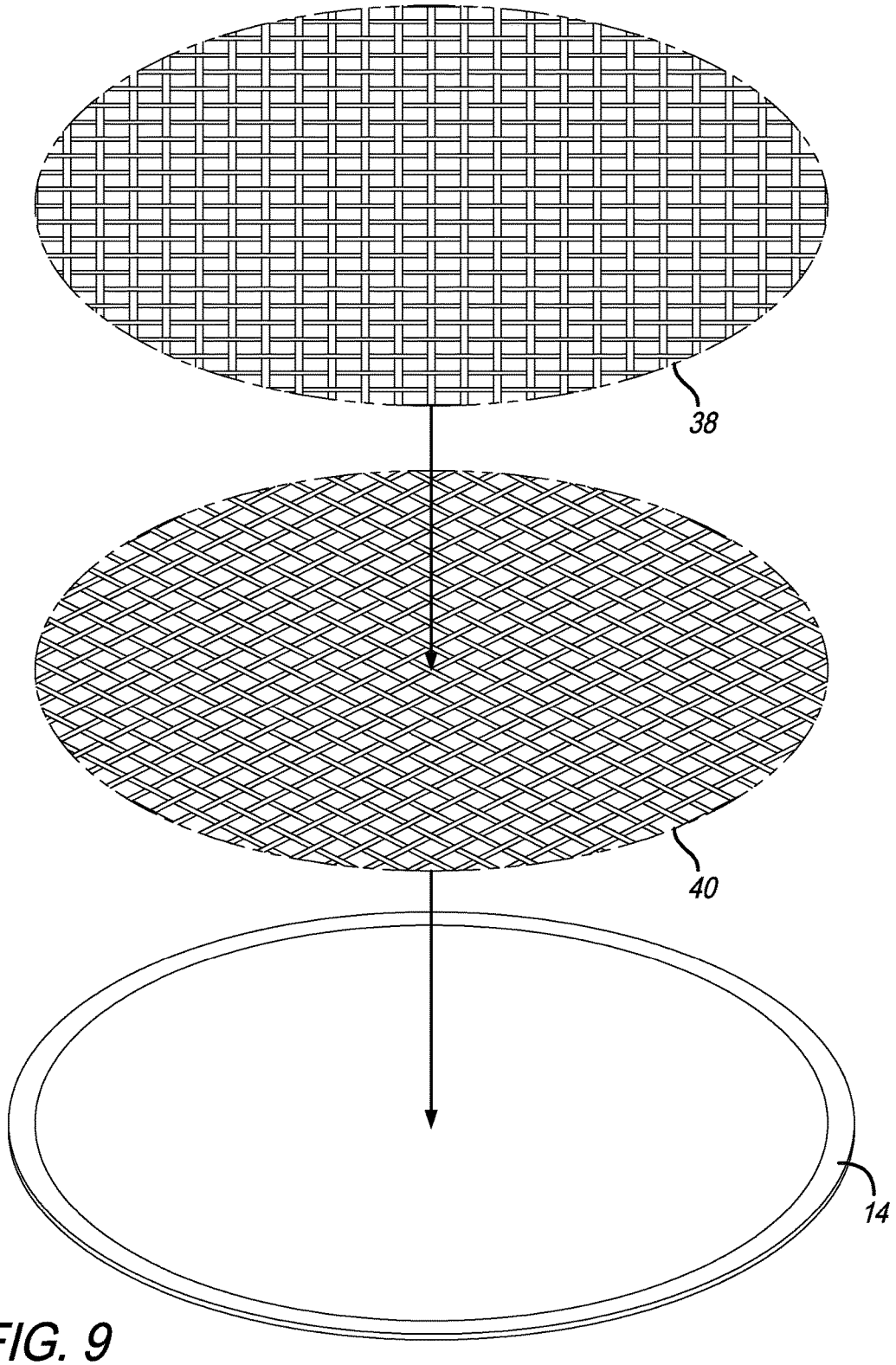
FIG. 9 is a perspective view of a drumhead in accordance with the present invention shown with two layers of woven mesh fabric about to be joined together in an off-biased orientation relative to one another.
Figure 10:
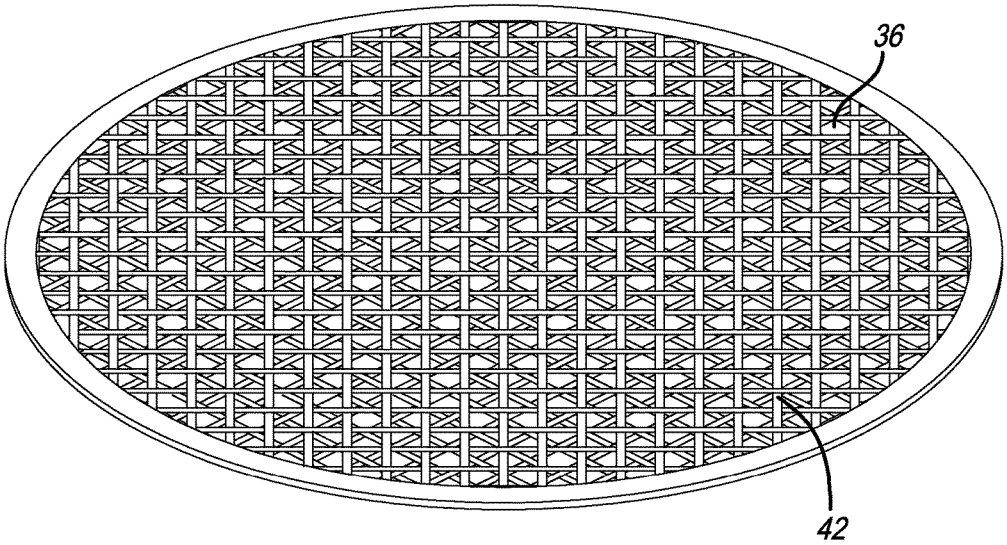
FIG. 10 is a perspective view of a drumhead in accordance with the present invention shown with one layer of woven mesh fabric placed in an off-biased orientation relative to a second layer of woven mesh fabric.
Figure 12:
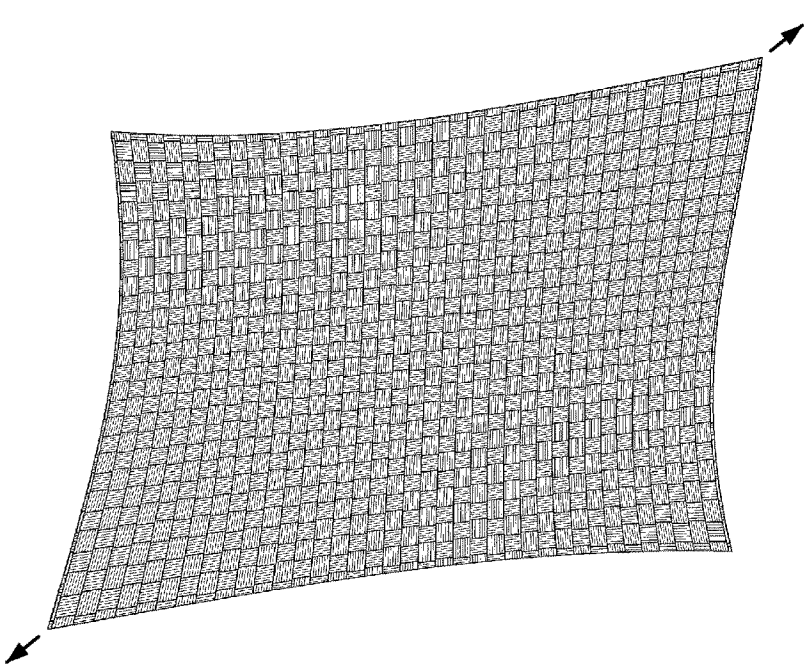
FIG. 12 is a perspective view of the plain woven Kevlar® material of FIG. 11 shown stretched or tensioned in an off-biased manner.
Figure 11:
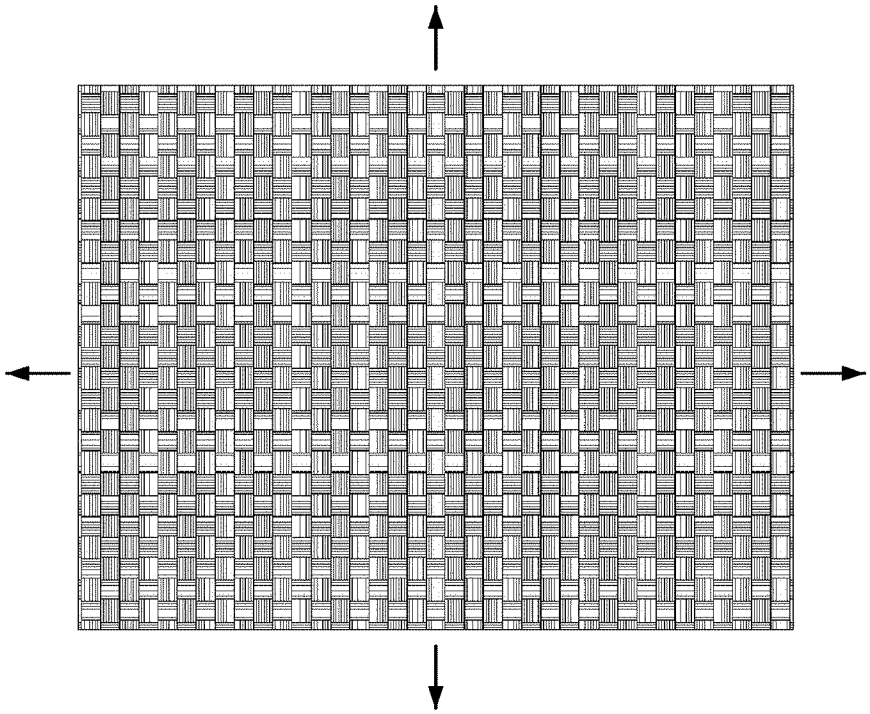
FIG. 11 is a perspective view of plain woven Kevlar® material.

In addition to a single layer of open weave mesh fabric material 10, knitted mesh fabric material 11 and 13, or knotted mesh fabric material (not shown) used in accordance with the present invention, two or more layers of, for example, open weave mesh fabric material 38,40, as shown in FIGS. 9,10, may be combined in an overlay manner to achieve the objectives described heretofore. For example, one such layer of open weave mesh fabric material 38 may be placed in an off-biased orientation 42 relative to one or more of such other layers of material 40 to prevent the material, when incorporated as the drumhead component of a musical drum, from being distorted or pulled unevenly when tensioned or stretched. The overlay of fabric materials 38,40, shown in FIG. 9,10, depending on how the layers are oriented relative to one another can be utilized to adjust the size of openings 36 for regulating the amount of air that passes through the fabric and to increase the overall durability and tension capabilities of the drumhead.

While the invention will be described in connection with a certain preferred embodiment, it is understood that it is not intended to limit the invention to that embodiment. Rather, it is intended to cover all alternatives, modifications and equivalents as may be included within the spirit and scope of the invention as defined by the appended claims.

The invention claimed is:

1. A musical drumhead for use as a batter head of a single-headed or double-headed drum, said double-headed drum also having a resonant drumhead, said musical drumhead comprising:

a plurality of multifilament yarns joined together to form an open mesh fabric, said individual multifilament yarns having uneven or undulating surfaces for enabling a strong bond with an applied coating means, said multifilament yarns being individually encapsulated by said coating means, wherein said open mesh fabric when struck by a hard object absorbs vibrations and simulates the sound properties of a synthetic drumhead at substantially reduced sound levels.

2. The musical drumhead of claim 1 wherein a plurality of soft fiber tufts are integrated into said open mesh fabric to enhance the absorption of vibrations and the further reduction of sound levels when said open mesh fabric is struck by a hard object.

3. The musical drumhead of claim 1 wherein said multifilament yarns are twisted.

4. The musical drumhead of claim 1 wherein said multifilament yarns are braided.

5. The musical drumhead of claim 1 wherein said open mesh fabric is knitted.

6. The musical drumhead of claim 1 wherein said open mesh fabric is knotted.

7. The musical drumhead of claim 1 wherein said coating means secured in fixed position the pattern of said open mesh fabric thereby precluding off-bias stretching of said mesh fabric upon the tensioning of said drumhead in any direction of a polar array.

8. The musical drumhead of claim 1 wherein said coating means secured in fixed position the weave pattern of said mesh fabric upon the striking of said drumhead by a hard object.

9. The musical drumhead of claim 1 wherein said coating means comprises material made of polyvinyl chloride.

10. The musical drumhead of claim 1 wherein said coating means comprises material made of polyvinylidene fluoride.

11. The musical drumhead of claim 1 wherein said coating means comprises material made of high density polyethylene.

12. The musical drumhead of claim 1 wherein said coating means comprises material made of chlorosulfonated polyethylene.

13. The musical drumhead of claim 1 wherein said open mesh fabric comprises a pattern of intersecting said individual multifilament yarns defining adjacent openings to enable the passage of air through said batter head.

14. The musical drumhead of claim 1 wherein said multifilament yarn comprises material made of polyester.

15. The musical drumhead of claim 1 wherein said multifilament yarn comprises material made of nylon.

16. The musical drumhead of claim 2 wherein said soft fiber tufts are bonded to said open mesh fabric to reduce the initial contact noise and any accompanying drumhead reverberations produced when said drumhead is struck by a hard object.

17. The musical drumhead of claim 1 wherein said open mesh fabric when struck by a hard object produces a clear tone absent the predominance of acoustic noise.

18. The musical drumhead of claim 1 wherein said hard object is a drumstick.

19. The musical drumhead of claim 1 wherein said hard object is a drum mallet.

20. The musical drumhead of claim 1 wherein said drumhead is integral to an electric percussion instrumental system.

21. The musical drumhead of claim 1 wherein said drumhead is integral to an acoustic percussion instrument.

22. The musical drumhead of claim 13 comprising two or more layers of said open mesh fabric.

23. The musical drumhead of claim 22 wherein one layer of said open mesh fabric is placed in an off-biased orientation relative to said other layer of said open mesh fabric.

24. The musical drumhead of claim 23 wherein said layers of said open mesh fabric rotate separately to adjust the size of said openings.

* * * * *